US006397567B1

(12) United States Patent
Focke et al.

(10) Patent No.: US 6,397,567 B1
(45) Date of Patent: Jun. 4, 2002

(54) PROCESS AND APPARATUS FOR PRODUCING (LARGE) PACKS

(75) Inventors: Heinz Focke, Verden; Wolfgang Heinzig, Apen, both of (DE)

(73) Assignee: Focke & Co. (GmbH & CO) (DE)

( * ) Notice: Subject to any disclaimer, the term of this patent is extended or adjusted under 35 U.S.C. 154(b) by 0 days.

(21) Appl. No.: 09/371,210

(22) Filed: Aug. 10, 1999

(30) Foreign Application Priority Data

Aug. 21, 1998 (DE) ..... 198 38 076

(51) Int. Cl.[7] ..... B65B 35/52
(52) U.S. Cl. ..... 53/541; 414/790.3; 414/795.3
(58) Field of Search ..... 53/447, 540, 541; 414/790.3, 795.3

(56) References Cited

U.S. PATENT DOCUMENTS

| | | | | | |
|---|---|---|---|---|---|
| 2,924,051 | A | * | 2/1960 | More | 53/541 |
| 2,937,482 | A | * | 5/1960 | Lazott et al. | 53/541 |
| 2,941,339 | A | * | 6/1960 | Salwasser | 53/447 |
| 3,225,512 | A | * | 12/1965 | Bulger | 53/541 |
| 3,250,376 | A | * | 5/1966 | Griner et al. | 53/541 |
| 3,570,209 | A | | 3/1971 | Salwasser | |
| 4,517,791 | A | * | 5/1985 | Focke | 53/541 |
| 5,136,826 | A | | 8/1992 | Carson et al. | |
| 5,794,417 | A | * | 8/1998 | Mohrman | 53/541 |
| 5,809,745 | A | * | 9/1998 | Reinert | 53/447 |

FOREIGN PATENT DOCUMENTS

| | | |
|---|---|---|
| CH | 512 355 | 9/1971 |
| DE | 31 10 720 A1 | 10/1982 |
| EP | 01 11 446 A1 | 11/1983 |
| GB | 739373 | 10/1955 |
| GB | 1196572 | 7/1970 |
| GB | 1 298 361 | 11/1972 |
| GB | 1 299 345 | 12/1972 |
| GB | 2 006 154 A | 5/1979 |
| GB | 2 120 198 A | 11/1983 |

* cited by examiner

*Primary Examiner*—John Sipos
(74) *Attorney, Agent, or Firm*—Todd Deveau; Ryan A. Schneider; Troutman Sanders LLP

(57) ABSTRACT

Process and apparatus for introducing elongate, in particular cylindrical, articles, namely packs (10), into a carton (15). The packs (10) arrive individually, and at a spacing from one another, on a feed conveyor (18) and are pushed off from the latter transversely, by a pack pusher (26), into a collecting station (19). Layers (17) comprising a plurality of packs (10) located one beside the other are formed in said collecting station. The layers (17) are then raised one after the other and introduced into a grouping subassembly in order to form groups (16) comprising a plurality of layers. In each case one group, in turn, is pushed into a carton (15) which is open on at least one side.

9 Claims, 8 Drawing Sheets

Figure 1:
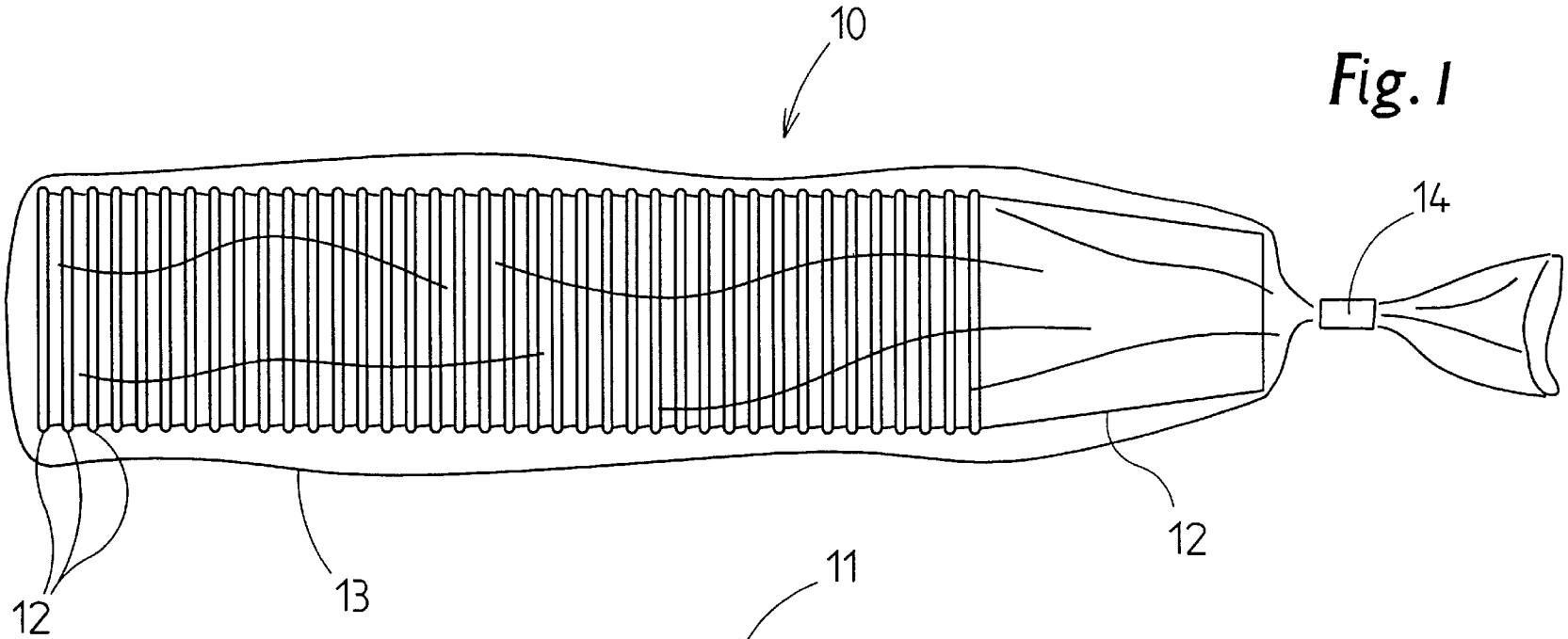

10
14
12
13
12

11
14
12

26
18
22
20
10
27

19
10
20
22
26
23
V
V
22
18
10
21
23

PROCESS AND APPARATUS FOR PRODUCING (LARGE) PACKS

The invention relates to a process for producing large packs—multipacks—from a plurality of articles of the same size, in particular from (soft) packs, such as series of stacked cups, by introduction into cartons or other large containers The invention also relates to an apparatus for carrying out the process.

It is difficult for, in particular, elongate, cylindrical articles which can only be subjected to low loading to be packaged in cartons. This applies, in particular, to series of stacked cups. The latter constitute a relatively large number of drinking cups which are inserted one inside the other, are made of plastic or paperboard and are enclosed by a bag-like outer wrapper. These series of stacked cups have to be introduced into cartons for despatch and for storage.

The object of the invention is to propose measures for cost-effective, careful and exclusively mechanical packaging of series of stacked cups and similar articles, to be precise without manual intervention.

In order to achieve this object, the process according to the invention is characterized by the following features:

a) the articles are fed individually, and at a spacing from one another, with their longitudinal extent oriented in the conveying direction, b) a plurality of articles are displaced one after the other in the transverse direction in order to form a layer of articles, c) the layers are conveyed one after the other in the upward direction in order to form a group comprising a plurality of layers of articles, and d) the group is pushed into an open container in the longitudinal direction of the articles and in a horizontal plane.

Accordingly, in the case of the process according to the invention, a completed group of the carton contents is formed and then pushed, as a unit, into the laterally open carton in the horizontal direction. In the case of series of stacked cups with a conical profile, the (smaller) base surfaces are located at the front as they are pushed in in the conveying direction, with the result that the pushed-in unit or group has a certain wedge-shaped configuration.

The apparatus according to the invention comprises a layer station, in the region of which layers comprising a plurality of articles positioned one beside the other are formed on a platform. These layers are moved upwards, by the platform, into a grouping station in order to form the group comprising a plurality of layers arranged one above the other. The articles, or series of stacked cups, collected there, are retained at their ends, to be precise in particular by mechanical pressure and/or by suction. It is also possible to provide movable supporting elements for the group or subgroup.

The apparatus has elements for actuating the platform and for actuating pushers and movable retaining and guide elements, which provide for the correct support and alignment of the articles in the stations. A funnel-like guide or a mouthpiece is provided so that the group can be pushed into a carton correctly.

Figure 2:
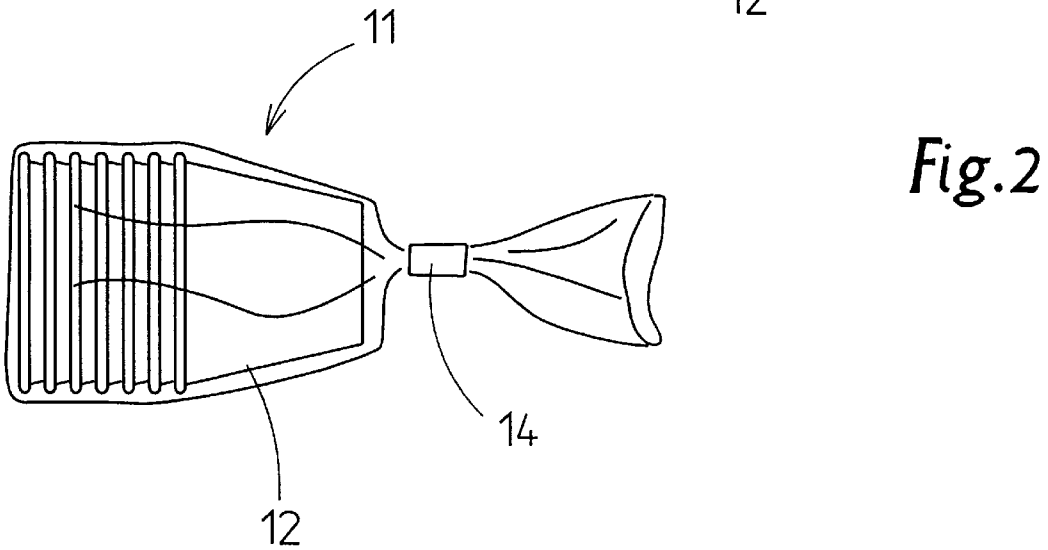
Figure 3:
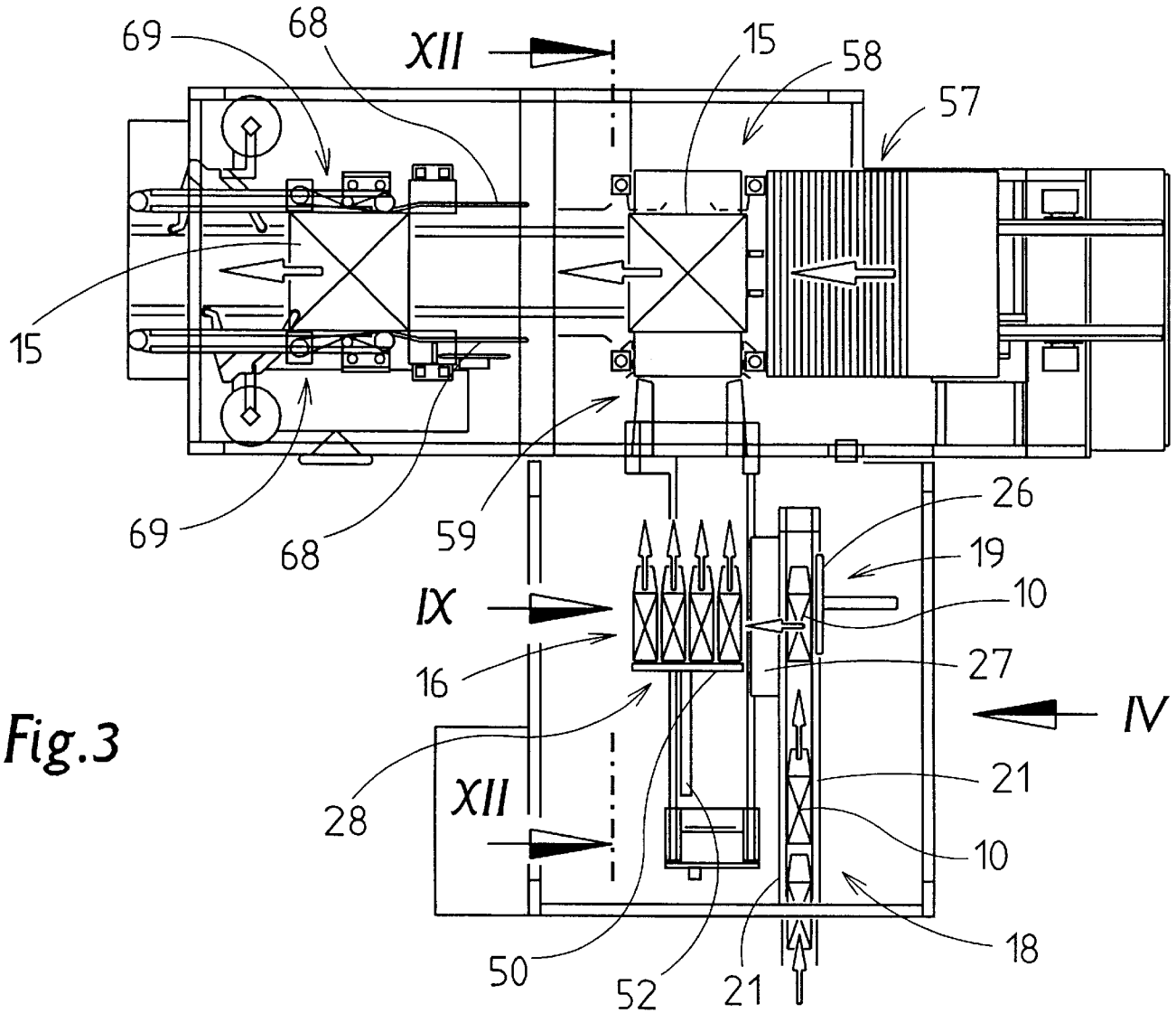
Figure 5:
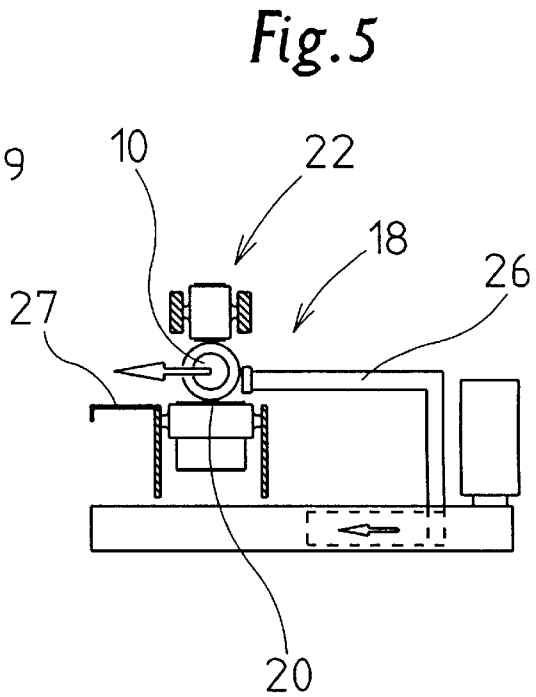
Figure 4:
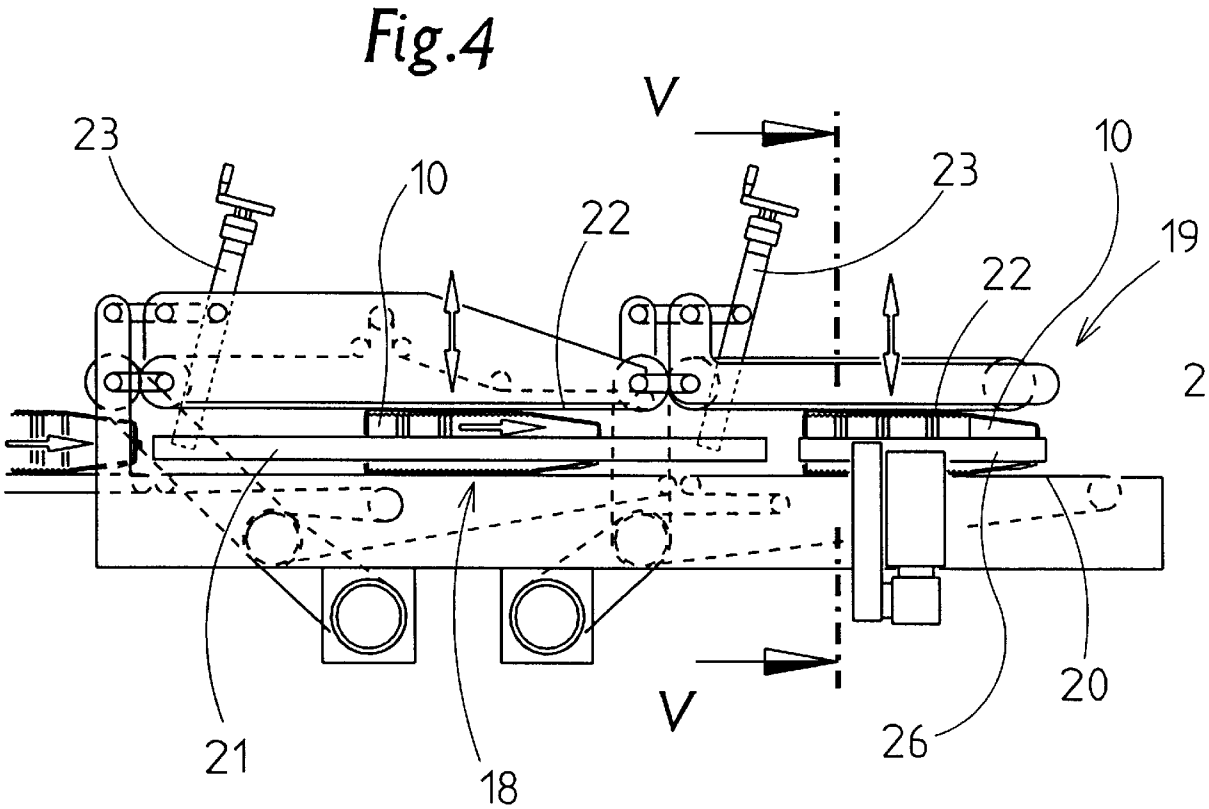
Figure 7:
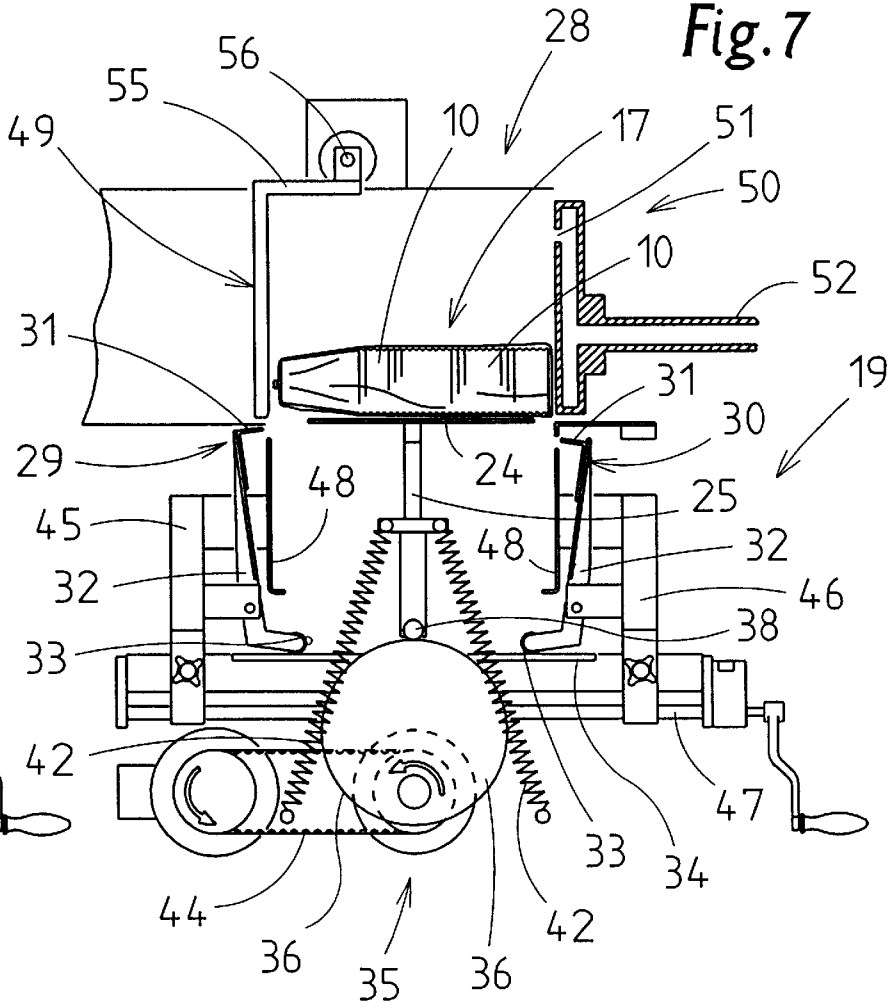
Figure 6:
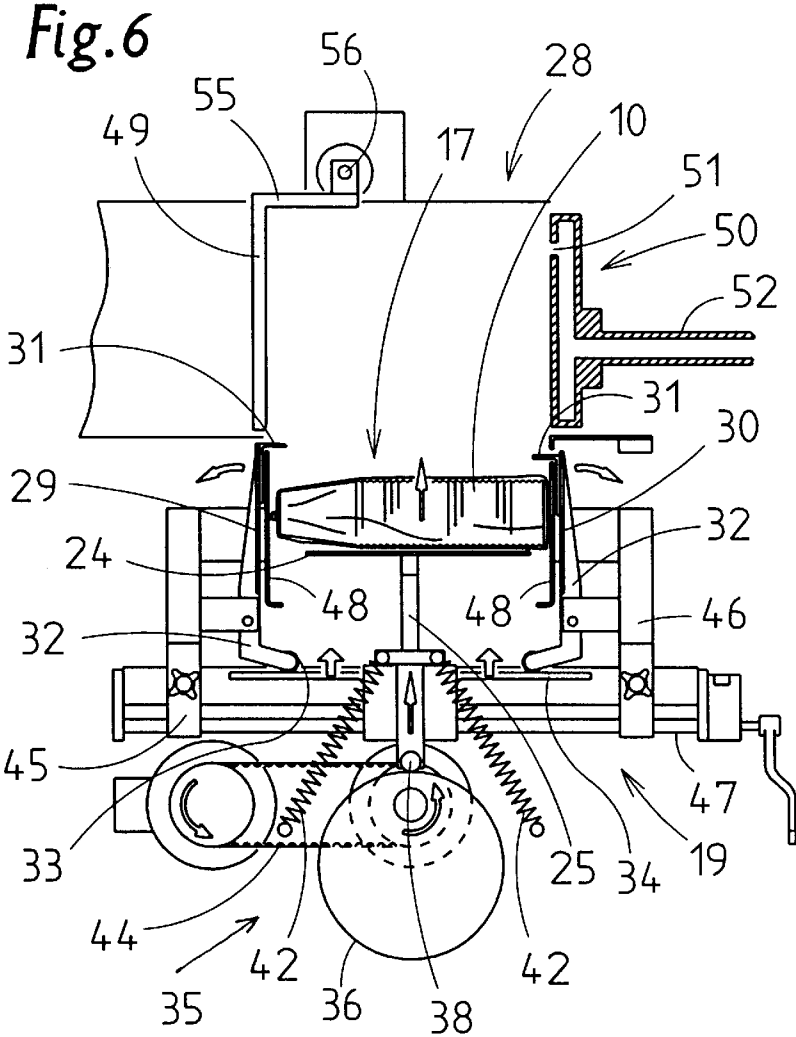
Figure 9:
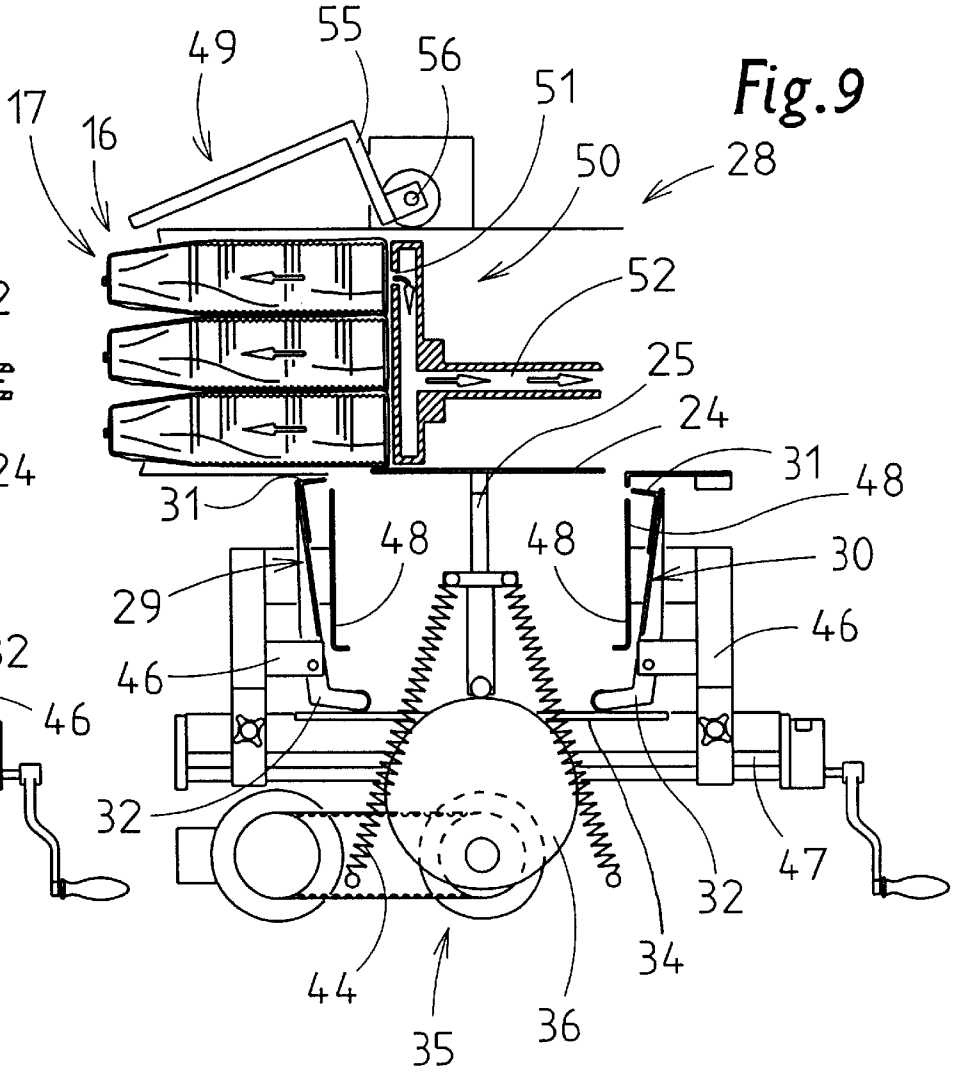
Figure 8:
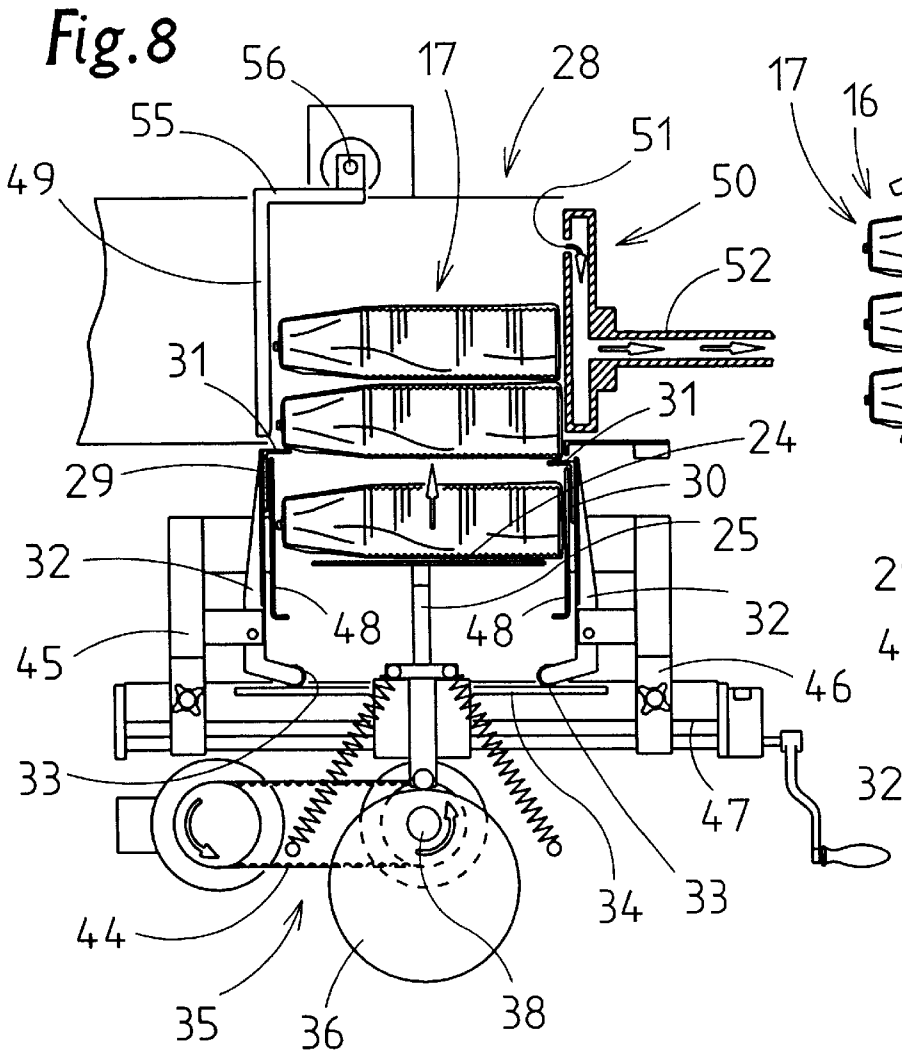
Figure 11:
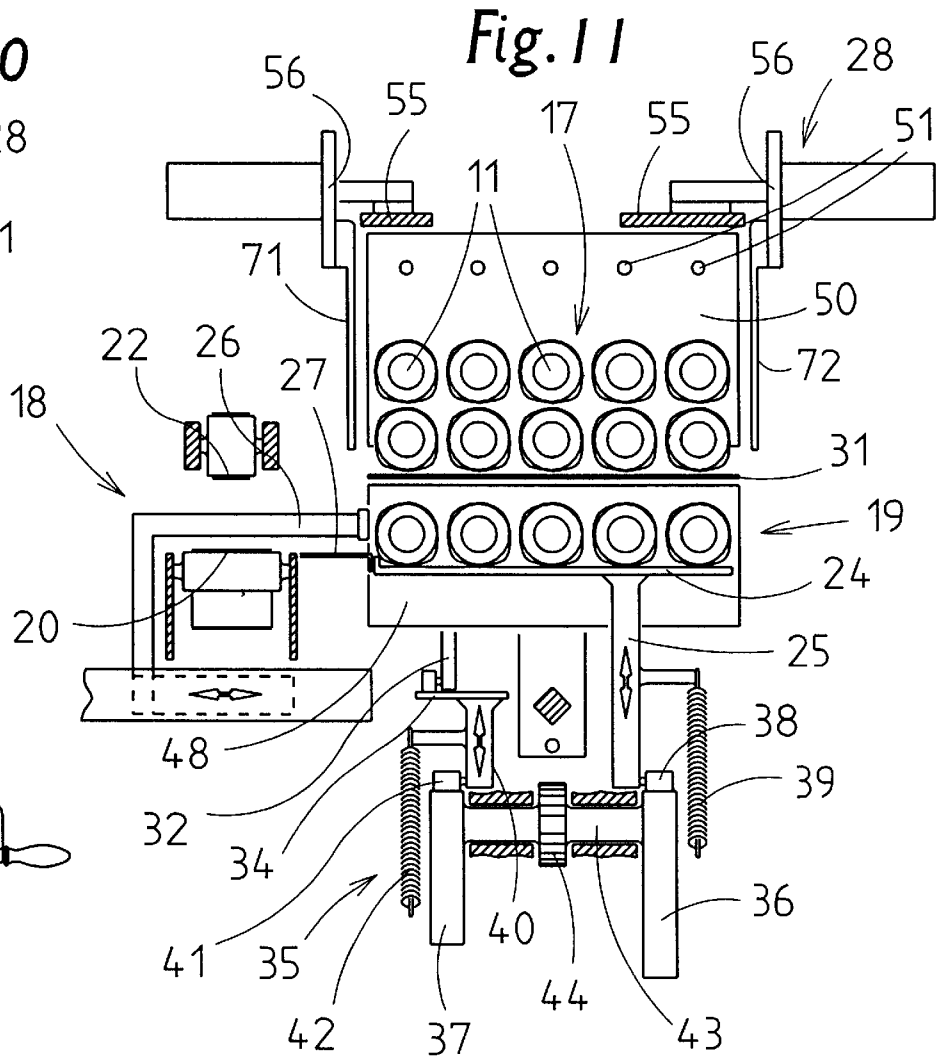
Figure 10:
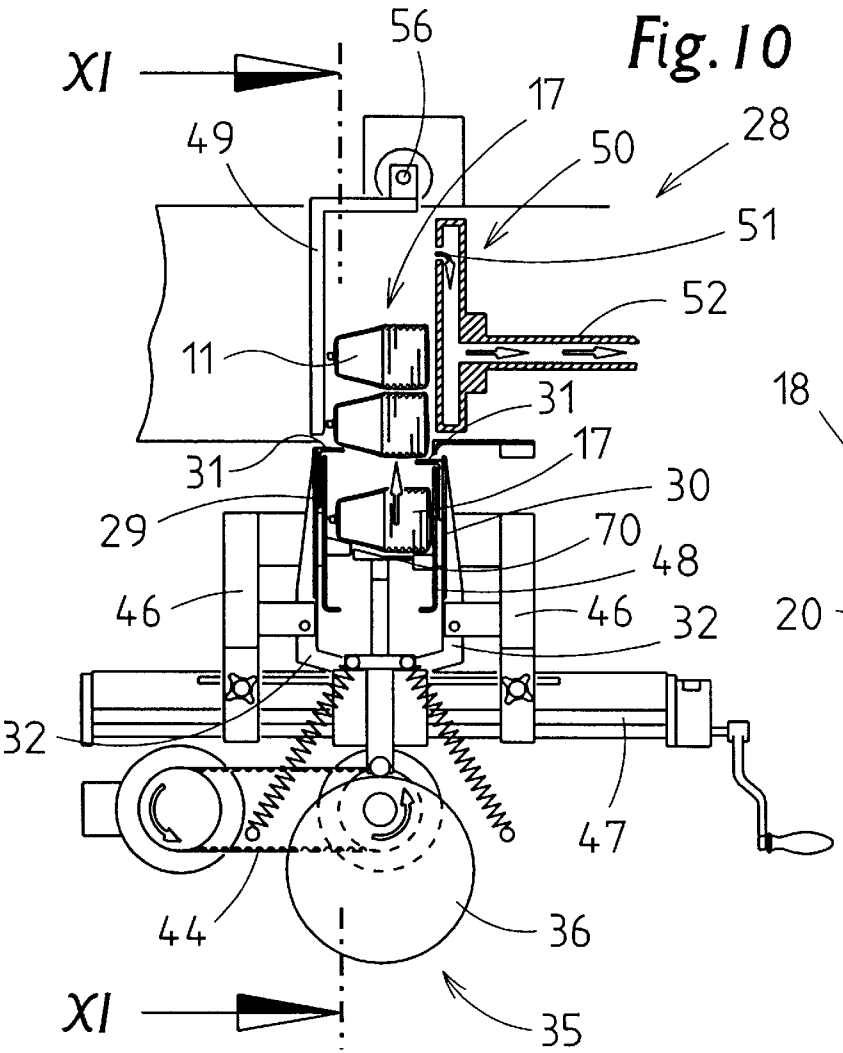
Figure 12:
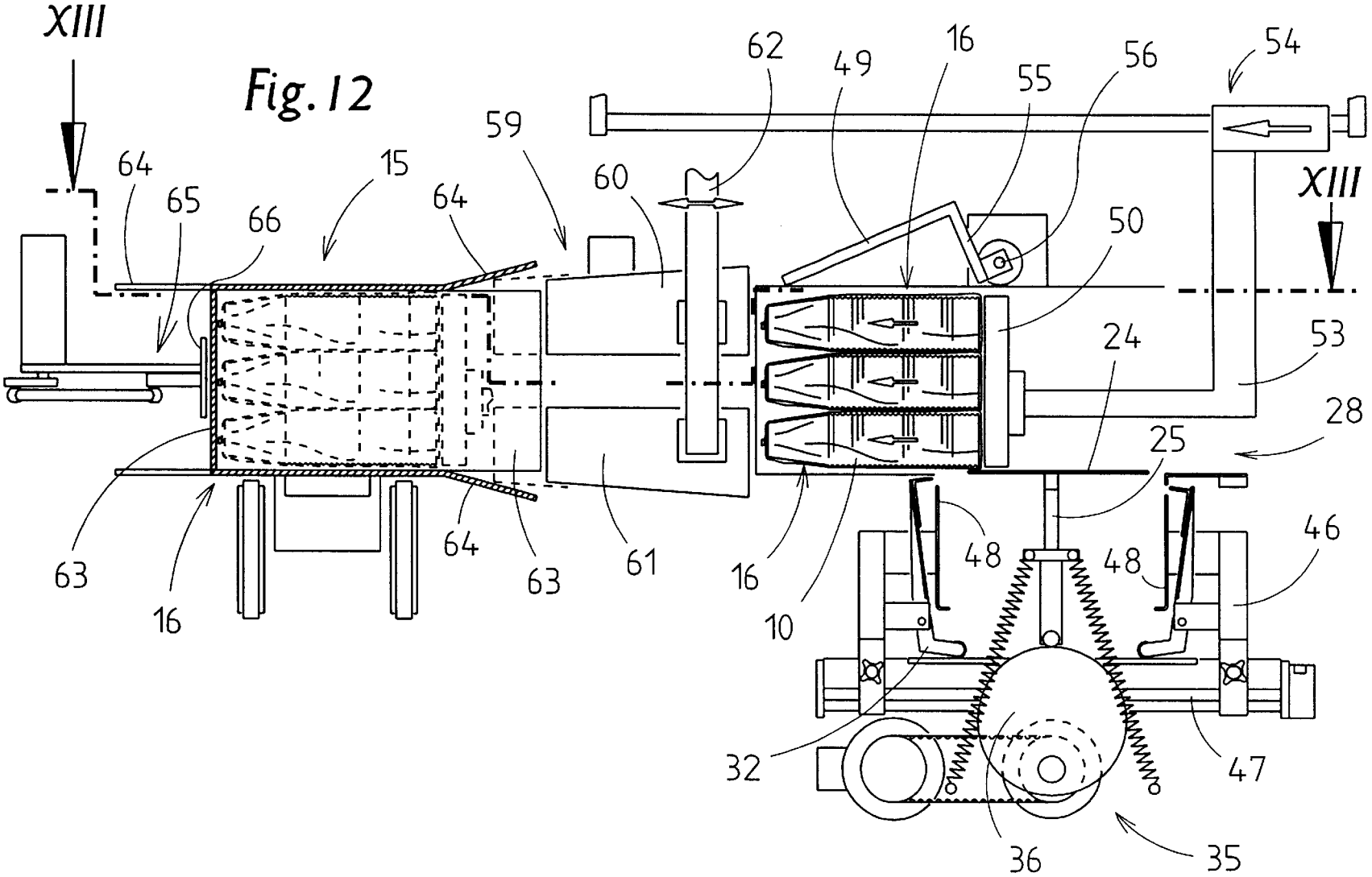
Figure 13:
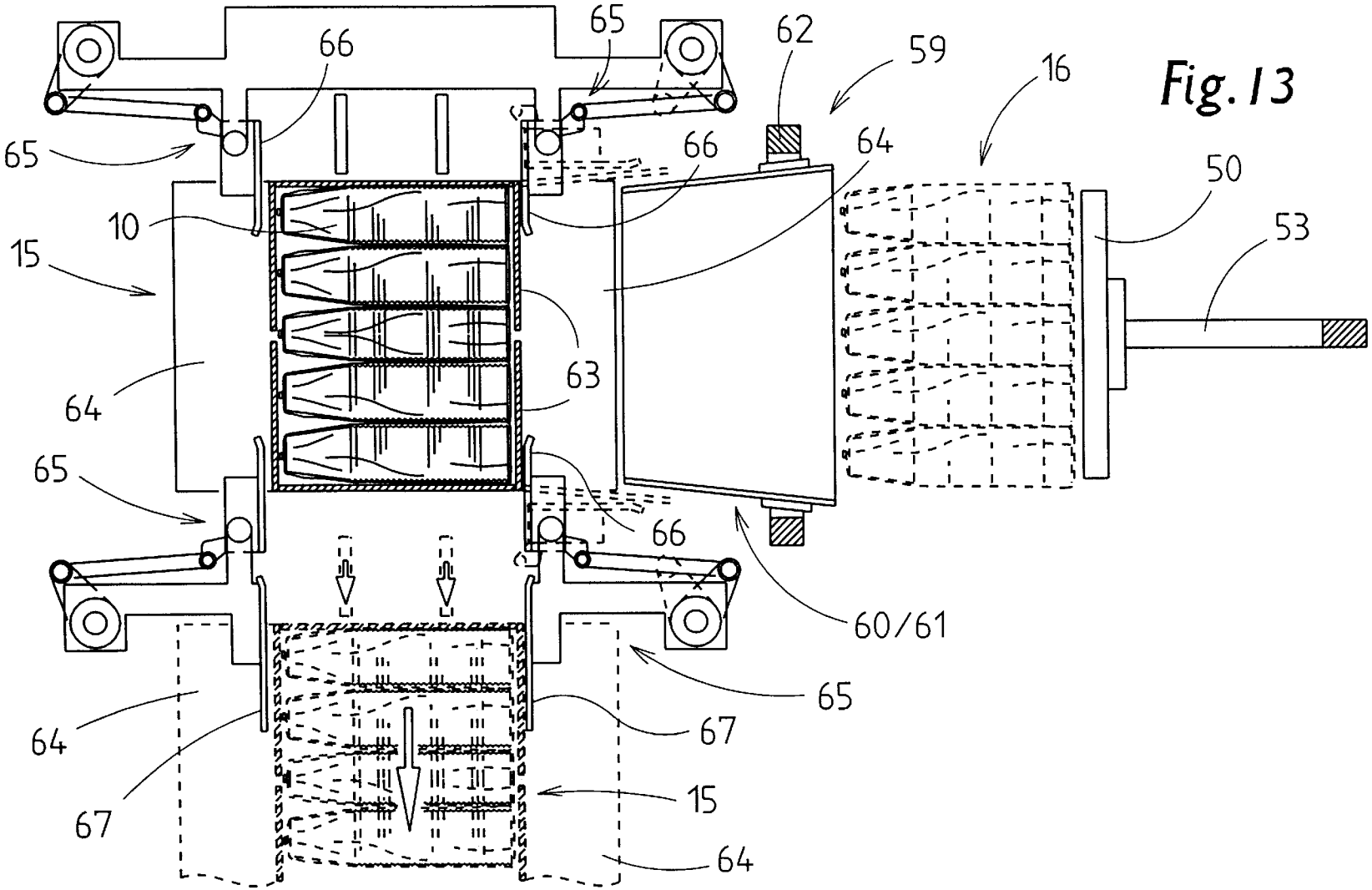

Further details of the process and of the apparatus are explained in more detail hereinbelow with reference to details of the process and of the apparatus, these details being illustrated in the drawings, in which:

FIG. 1 shows a side view of an elongated (soft) pack, namely a series of stacked cups, FIG. 2 shows a pack in a different form, namely a short series of stacked cups, FIG. 3 shows amplified plan view of an apparatus, namely packaging machine, FIG. 4 shows a side view of a subregion of the apparatus according to FIG. 3 corresponding to arrow IV in FIG. 3, FIG. 5 shows a detail of the packaging shown in cross-section along the section plane V—V in FIG. 4, FIG. 6 shows a cross-sectional view of a detail of the packaging machine, namely a collecting station for packs, FIG. 7 shows the detail according to FIG. 6 with changed relative positioning, FIG. 8 shows the detail according to FIGS. 6 and 7 during the formation of a group of packs, FIG. 9 shows the detail according to FIGS. 6 to 8 as a completed group of packs is pushed off, namely a view corresponding to arrow IX in FIG. 3, FIG. 10 shows the station according to FIGS. 6 to 9 in an embodiment for (small and/or short) packs according to FIG. 2, FIG. 11 shows a transverse view of the station according to FIG. 10 along a section plane XI—XI in FIG. 10, FIG. 12 shows the apparatus according to FIG. 3 in a side view or along a section plane XII—XII in FIG. 3, and FIG. 13 shows a plan-view illustration of FIG. 12 as seen along section plane XIII—XIII.

The apparatus shown serves for the packaging of specific articles, in particular elongate, more or less cylindrical packs 10 and 11 which can only be subjected to low mechanical loading and are not of rigid form. The actual example in hand deals with series of stacked cups, that is to say a group of (drinking) cups 12 made of plastic, paperboard or similar material. The, for example, frustoconical cups 12 are inserted one inside the other to give elongate, more or less cylindrical structure. The group of cups 12 is enclosed by an outer wrapper, in the present case by a sheet-material bag 13, which is closed by a clip 14 or the like at one end, in the present case in the region of an outer, exposed end cup 12.

The pack 11 according to FIG. 2 is designed in the same way. The cups 12 are of a lesser size and/or height. It is also the case that the number of cups 12 making up a unit is smaller than in the case of the example of FIG. 1. This results in a considerably shorter pack 11.

The packs 10, 11 are intended to be packaged in a large container, namely in a carton 15. The procedure in this case is such that first of all a group 16 of packs 10, 11 is formed and this group 16, which forms the contents of the carton 15, is then pushed into the open carton 15. The group 16 comprises a plurality of packs 10, 11 which are arranged one above the other in layers 17. For example, a group 16 comprises three layers 17 formed one above the other. Each layer comprises a plurality of, for example five, packs 10, 11 located one beside the other.

The packs 10, 11 are set individually, and at a spacing from one another, to the packaging machine, to be precise a collecting station 19, on a feed conveyor 18. The feed conveyor 18 comprises a bottom belt 20, on which the packs 10, 11 rest with their longitudinal extent oriented in the conveying direction. Side guides 21 serve for securing an aligned, correct position of the packs 10, 11 on the feed conveyor 18. On account of the packs 10, 11 being particularly sensitive, there is also provided a top belt 22, which extends, at least in a subregion of the conveying path, above the bottom belt 20, to be precise at a spacing therefrom which corresponds approximately to the height dimension or the diameter of the packs 10, 11. The top belt 22 forms a top guide and is driven in the same way as the bottom a belt 20.

In the case of the present example (FIG. 4), the bottom belt 20 and top belt 22 comprise a plurality of conveying belts which follow one after the other as sections and are driven together or separately. In particular, the conveying belts may be driven such that the packs 10, 11 reach the collection station 19 at certain, predetermined spacings. Moreover, the top belts 22 can be adjusted in height by an adjustment gear mechanism 23 for adaptation to different dimensions of the packs 10, 11.

In the region of the collection station 19, the packs 10, 11 are pushed off one after the other from the feed conveyor 18 in the direction transverse to their axis and deposited on a collecting and lifting element, namely on a platform 24. The latter is a carrying plate which can be moved up and down by a push rod 24 which is provided on the underside.

On the platform 24, completed loads 17 are formed one after the other by virtue of a corresponding number of incoming packs 10, 11 being displaced. In this case, the packs 10, 11 are pushed out sideways between the bottom 20 and top belt 22 by a pack pusher 26. Via a bridge plate 27, the packs 10, 11 pass one after the other onto the platform 24, on which they are aligned and positioned closely one beside the other.

A completed layer 17 is introduced into a grouping subassembly 28 by virtue of the platform 24 being moved upwards. Said grouping subassembly collects a plurality of layers 17 one above the other in order to form a group 16.

The packs 10, 11 are introduced into the grouping subassembly 28 in layers, by the platform 24, from beneath, subsequent layers 17 correspondingly raising those which have already been fed beforehand until the group 16 is completed. The grouping subassembly 28 has retaining elements for retaining the packs 10, 11 or the layers 17. The respectively bottom layer 17 is retained by supporting elements acting on the ends of the packs 10, to be precise by supporting angles 29, 30. Ends of the packs 10, 11 are borne by in each case one transversely directed leg 31. The supporting angles 29, 30 can be moved, namely pivoted, transversely such that, when a layer 17 is pushed into the region of the grouping subassembly 28, the legs 31 are drawn back from the movement region of the packs 10, 11. For this purpose, the supporting angles 29, 30 are provided on pivotable, two-armed levers 32. The latter can be pivoted in opposite directions and, for this purpose, rest, by way of supporting rollers 33, on a support which can be moved up and down, namely on an actuating plate 34. The latter can be raised when the supporting angles 29, 30 and/or the legs thereof 31 are moved out of the supporting position (FIG. 7).

The platform 24 and the push rod 25 as well as the supporting means 29, 30 move in a coordinated manner by way of a common (mechanical) gear mechanism 35.

Elements are made to move up and down by eccentric plates 36, 37. A front eccentric plate 36, which can be seen FIGS. 6 to 9, controls the movement of the push rod 25. The latter is supported, by way of a contact roller 38, on the surface of the rotationally driven eccentric plate 36. The latter can be moved such that, in an extreme position (FIG. 7), the packs 10, 11 or the layer 17 are/is introduced into the grouping subassembly 28. In the other end position, the platform 24 is located in the bottom position for the feeding of the packs 10, 11. The contact roller 38 is forced against the circumference of the eccentric plate 36 by way of a spring 39 which is subjected to tensile loading.

The other eccentric plate 37 serves for moving the actuating plate 34 up and down (FIG. 11). The latter is provided on a support 40 which, for its part, butts against the circumference of the eccentric plate 37 by way of a contact roller 41. The latter is forced against the circumference by a further spring 42.

The two eccentric plates 36, 37, are mounted on a common shaft 43, that is to say they are provided at the ends of the latter. Said shaft is driven in rotation in time with the packaging machine, in this case via a toothed belt 44.

The Supporting means 29, 30 or the angled levers 32 of the latter are each provided on an upright carrying framework 45, 46. The two carrying frameworks 45, 46 can be moved in opposite directions by a suitable adjustment gear mechanism, for example by a manually operable spindle 47, and can thus be moved into a precise position relative to the packs 10, 11 and can also be adapted to different pack sizes (FIG. 10).

Furthermore, upright guide plates 47, 48 are provided on the carrying frameworks 45, 46. These guide plates form upright guides for the packs 10, 11 on the platform 24, in particular during the upward movement of the latter.

The grouping subassembly 28 has at least two mutually opposite retaining elements, namely retaining plates 49, 50. These elements are arranged at a spacing from one another which corresponds to the length of the articles or packs 10, 11. The packs 10, 11 butt against the retaining plates 49, 50 by way of their end surfaces, which in this case are the base wall, on the one hand, and open wall, on the other hand, of the cup 12. The dimensions are selected such that a longitudinally acting axial pressure is exerted on the packs 10, 11.

In addition, the packs 10, 11 may be retained in the region of the grouping subassembly 28 by suction air. In the case of the exemplary embodiment shown, a row of suction bores 51 is provided on the retaining plate 50, to be precise level with a top, third or fourth layer 17. The suction bores 51 are provided such that in each case one suction bore 51 is assigned to one pack 10, 11 and transmits suction air to the packs 10, 11 in the region of the end surfaces. For this purpose, the retaining plate 50 is designed as a hollow body. The suction bores 51 are connected to a negative-pressure source via the hollow retaining plate 50 and a likewise hollow push rod 52. As an alternative, it is also possible for the retaining plate 50 to be designed such that a row of suction borer 51 is provided for each layer 17. Moreover, in order to improve the retaining function, it is also possible for the opposite retaining plate 49 to be designed with suction bores.

When a completed group 16 has been formed within the grouping subassembly 28 (FIGS. 9 and 12), this group 16 in pushed, as a unit, out of the grouping subassembly 28 along a horizontal conveying path and fed to the carton 15 which has been kept at the ready. In this case, a retaining plate 50 serves as pusher. The latter butts against the larger end surfaces of the packs 10, 11, while conically tapering ends, with the base wall of the cups 12, are located at the front in the conveying direction. The retaining plate 50 is connected to a linear drive 54 via an angled arm 53. Said linear drive causes the retaining plate 50 to move as a pusher in the pushing direction of the group 16.

The retaining plate 49, which is located opposite the retaining plate 50, is moved out of the upright retaining position before the group 16 is pushed off (FIG. 12). The retaining plate 49 is provided on a carrying arm 55, which can be pivoted about a rotary bearing 56. Accordingly, the retaining plate 49 is moved out of the movement path of the group 16 by virtue of upwardly directed pivoting.

The carton 15 is removed from a carton magazine 57. The cartons 15 are prepared to the extent where they can be folded from a flat, collapsed position into a three-dimensional tubular form. In the region of a filling station 58, the erected carton 15 is kept at the ready with an open side directed towards the fed group 16. The group 16 is pushed into the end position within the carton by the retaining plate 50, which acts as a pusher (FIGS. 12 and 13). In order to ensure that the group 16, which essentially fills the interior of the carton 15, is pushed into the carton without disruption, a mouthpiece 59 is arranged, as a funnel-like filling element, in the region between the collecting station 19 and/or the grouping subassembly 28, on the one hand, and the filling station 58, on the other hand. The mouthpiece 59 comprises a plurality of, namely two, guide elements 60, 61. These are essentially U-shaped in cross section, but are designed with converging, that is to say funnel-like, walls in the movement direction of the group 16. Accordingly, the mouthpiece 59 is open centrally in the lateral region (FIG. 12). The mouthpiece 59 and/or the guide elements 60, 61 are/is provided on a common carrier 62, namely on a carrying arm. The latter can be moved back and forth in the conveying direction of the group 16 in accordance with the arrow. Once the group has been pushed into the mouthpiece 59, the latter is moved on into the carton 15 with the group 16. The end position (dashed lines in FIG. 12) is located in the region of folding flaps of the carton, namely upright, inner flaps 63 and transversely, that is to say horizontally, directed top and bottom, outer flaps 64. These folding flaps are brought into a funnel-like position by the mouthpiece 59, with the result that the group 16 can be pushed in correctly.

Once the group 16 has been introduced into the carton 15, the mouthpiece 59 returns into a starting position (FIG. 12), outside the region of the folding flaps 63, 64. The pusher or the retaining plate 50 likewise returns into the starting position. It is necessary beforehand to fold the folding flaps 63, 64 on the mutually opposite sides. First of all, the inner flaps 63 on the opposite side from the mouthpiece 59 are folded, to be precise by laterally arranged, pivotable folding elements 65. The latter are pivotable folding plates 66 which are positioned approximately half way up the carton 15 and are pivoted through approximately 90° out of a starting position outside the region of the carton 15 (FIG. 13, dashed lines), the inner flaps 63, which are arranged laterally in an upright position, being carried along in the process. These inner flaps are folded into the plane of the relevant carton wall (FIG. 13). The inner flaps 63 on the opposite side from the push-in side are folded before the group 16 is pushed in and thus from a stop wall for the group 16.

Further plate-like guide plates 67 are connected to the folding elements 65. Said guide plates are arranged in the plane of the folding plates 66 when the latter are located in the folding position. The guide plates 67 ensure precise guidance of the partially folded carton 15 when the latter, together with its contents, is transported away transversely to the feeding direction of the group 16 (FIG. 13). The guide plates 67 retain the inner flaps 63 in the folded position.

The outer flaps 64, which are directed sideways at the top and bottom, are folded by stationary folding elements, namely by so-called folding diverters 68, in a manner known per se during the transportation of the carton 15.

Once the carton 15 has been completed, that is to say once the folding thereof has been finished, said carton is moved past a tape subassembly 69 of known construction. Such a tape subassembly 69 is provided on both sides of the movement path of the carton 15 in order to apply an adhesive strip along a central abutment edge between the top and bottom outer flaps 64. The carton 15 is then ready to despatch.

The entire apparatus is set up such that adaptation to packs 10, 11 of different sizes, that is to say, for example, to shorter packs 11 (FIG. 2), is easily possible. FIGS. 10 and 11 show the details for processing this type of pack. Essentially, for this purpose, the adjustment gear mechanism 23 is used to change the spacing of elements in the region of the grouping subassembly. For this purpose, the carrying frameworks 45, 46 are moved-towards one another, this resulting in a spacing of the upright guide plates 47, 48 and of the further elements which corresponds to the dimensioning of the pack 11. However, the platform 24 has to be exchanged for a platform 70 of smaller dimensioning and with a contour which is adapted to the form of the packs 11. The retaining plates 49, 50 in the region of the grouping subassembly 28 can be adapted to the dimensions of the packs 11. The retaining plate 50 is moved into a position in which it is at a smaller spacing from the opposite retaining plate 49 (FIG. 10). The latter remains in the predetermined, non-changeable position.

What is claimed is:

1. An apparatus for forming a group of articles lying in rows one above another and for introducing the group of articles into a container, the apparatus comprising:

(a) a feed conveyor of a collecting station, wherein the articles can be fed individually to the feed conveyor;

(b) a horizontal platform in the region of the collecting station, means for vertically moving the platform; a transversely displaceable pack pusher for pushing the articles onto the platform in order to form layers of articles lying adjacent one another;

(c) a grouping subassembly, wherein the layers of articles can be fed successively on the grouping subassembly by an upward movement of the platform, and wherein positioned within the grouping subassembly are a plurality of layers of the articles positioned one above another to form a group of articles; and (d) a vertical first vertical retaining plate in the region of the grouping subassembly, wherein articles of the group abut with one end of the first retaining plate, and means for pushing the group of articles in a conveying direction from the platform into the container by the first retaining plate;

the first retaining plate being a first suction plate with at least one row of suction bores means for providing negative pressure to said bores for retaining facing ends of the articles to the suction plate, wherein each article within a layer is assigned to at least one suction bore, and wherein the group of articles are pushed from the platform into the container by means of the first suction plate while maintaining negative pressure at the suction bores.

2. The apparatus of claim 1, wherein the articles are elongate, approximately cylindrically configured soft packs.

3. The apparatus of claim 2, wherein the soft packs are cups.

4. The apparatus of claim 1 further comprising a second retaining plate opposite the first retaining plate, the second retaining plate adapted to pivot upward to permit the group of articles to be pushed off the platform.

5. The apparatus of claim 1 further comprising a mechanical gear mechanism, the mechanical gear mechanism having a push rod on the outer circumference of a rotating eccentric plate for moving the platform up and down.

6. The apparatus of claim 1 further comprising opposing supporting angles alongside the platform, each supporting angle comprising a transversely directed leg for supporting articles on the platform, the supporting angles adapted to pivot to draw back the transversely directed legs to no longer support the articles on the platform.

7. The apparatus of claim 6 wherein the supporting angles are pivoted by an actuating plate adapted to move up and down.

8. The apparatus of claim 6 further comprising an adjustment gear mechanism wherein the supporting angles are adapted to accommodate packs of articles differing in length on the platform.

9. The apparats of claim 1 further comprising a moveable funnel-like mouthpiece through which the group of articles are pushed in a conveying direction from the platform into the container by the first retaining plate, said mouthpiece moveable in the conveying direction of the group of articles to position folding flaps of the container into a funnel-like position and to introduce the group of articles into the container.

* * * * *